US006948549B2

(12) United States Patent
Wüst et al.

(10) Patent No.: US 6,948,549 B2
(45) Date of Patent: Sep. 27, 2005

(54) METHOD FOR CONTROLLING A VACUUM VALVE OF A VACUUM DIE CASTING DEVICE AND A VACUUM DIE CASTING DEVICE

(75) Inventors: Jürgen Wüst, Erding (DE); Klaus Währisch, Essen (DE); Dieter Auer, Markt Schwaben (DE); Elisabeth Wenzel, Maulbronn (DE); Christophe Bagnoud, Sierre (CH)

(73) Assignee: Alcan BDW GmbH & Co. KG, Markt Schwaben (DE)

( * ) Notice: Subject to any disclaimer, the term of this patent is extended or adjusted under 35 U.S.C. 154(b) by 0 days.

(21) Appl. No.: 10/489,577

(22) PCT Filed: Sep. 12, 2002

(86) PCT No.: PCT/EP02/10234

§ 371 (c)(1),
(2), (4) Date: Jan. 24, 2005

(87) PCT Pub. No.: WO03/022489

PCT Pub. Date: Mar. 20, 2003

(65) Prior Publication Data

US 2005/0126740 A1 Jun. 16, 2005

(30) Foreign Application Priority Data

Sep. 12, 2001 (DE) ..... 101 44 945

(51) Int. Cl.[7] ..... B22D 46/00

(52) U.S. Cl. ..... 164/457; 164/113; 164/154.2; 164/155.4; 164/312

(58) Field of Search ..... 164/113, 155.2, 164/155.4, 155.5, 154.2, 154.3, 312, 457

(56) References Cited

U.S. PATENT DOCUMENTS

| | | | | |
|---|---|---|---|---|
| 4,852,634 | A | 8/1989 | Kawai et al. | |
| 4,986,338 | A * | 1/1991 | Yamauchi et al. | 164/457 |
| 4,997,026 | A | 3/1991 | Ozeki et al. | |
| 5,361,826 | A * | 11/1994 | Yamauchi et al. | 164/457 |
| 5,460,218 | A | 10/1995 | Miwa et al. | |
| 6,082,438 | A | 7/2000 | Zielinski et al. | |
| 6,158,495 | A | 12/2000 | Bigger | |
| 6,298,903 | B1 | 10/2001 | Wyser et al. | |

FOREIGN PATENT DOCUMENTS

| | | |
|---|---|---|
| DE | 42 16 773 | 11/1993 |
| DE | 200 16 166 | 12/2000 |
| EP | 0 937 524 | 3/1999 |

(Continued)

*Primary Examiner*—Kuang Y. Lin
(74) *Attorney, Agent, or Firm*—Michael Best & Friedrich LLP

(57) ABSTRACT

A vacuum die casting apparatus includes a casting cavity (10), which is evacuatable via a vacuum valve (26). A liquid casting material is pressable into the casting cavity by a piston (14) actuated by an actuator (17). A filling level sensor (20) detects a predetermined filling level of the casting material in the casting cavity. A control device (34) is connected to the filling level sensor for controlling the vacuum valve, and a position sensor (32) is connected to the control device (34) for detecting movement of the piston (14). The control device generates a closing signal for the vacuum valve (26) when the piston, after reaching the position ($s_1$) at which the filling level sensor (20) indicates a predetermined filling level of the casting cavity (10) with casting material has been reached, is displaced in a predetermined manner.

13 Claims, 2 Drawing Sheets

FOREIGN PATENT DOCUMENTS

| | | |
|---|---|---|
| EP | 0 600 324 | 6/1999 |
| EP | 0 936 009 | 8/1999 |
| EP | 0 733 422 | 2/2000 |
| JP | 57-72766 | 5/1982 |
| JP | 63-303672 | 12/1998 |
| JP | 08099161 | 4/2004 |

* cited by examiner

METHOD FOR CONTROLLING A VACUUM VALVE OF A VACUUM DIE CASTING DEVICE AND A VACUUM DIE CASTING DEVICE

CROSS-REFERENCE

This application is the national stage filing of International patent application No. PCT/EP02/10234 filed Sep. 12, 2002, which claimed priority to German patent application No. 101 44 945.3 filed Sep. 12, 2001.

TECHNICAL FIELD

The invention concerns a method for controlling a vacuum valve of a vacuum die casting apparatus and a vacuum die casting apparatus.

THE RELATED ART

A vacuum die casting apparatus is known from DE 200 16 166 U1, in which the filling level of liquid metal injected into the casting cavity is detected by a metal contact sensor; upon coming into contact with the liquid metal, the sensor outputs a signal. A closing piston of the vacuum valve, which is driven by a linear motor, is moved in response to the signal so that the vacuum valve is entirely closed when the metal reaches the vacuum valve. In a further teaching, the known vacuum die casting apparatus utilizes a meandering vacuum and venting passage, in which a plurality of metal contact sensors are disposed and are connected to a computer; the computer controls the linear motor of the closing piston in accordance with the signals from the sensors.

If there is only one metal contact sensor, it is not possible to compensate for fluctuations in the speed at which the molten metal is injected during the manufacture of the castings; therefore, if the vacuum valve is not timely closed at high filling speeds, the evacuation will be prematurely ended, thereby possibly detrimentally influencing the quality of the casting. The use of a plurality of metal contact sensors is comparatively complicated and expensive.

SUMMARY OF THE INVENTION

The object of the invention is to provide a method and an apparatus that can manufacture castings of improved quality.

According to one method of the invention, the position of a piston, which presses or injects liquid casting material into a mold cavity, is detected, and the vacuum valve is closed in dependence on the piston position; as a result, it is possible for the vacuum valve to be reliably closed just before the casting material, preferably liquid metal, reaches the vacuum valve. In that way, the casting mold or the casting cavity can be connected to a vacuum source for as long as possible; thus, polluting gases, i.e., gases originating from lubricants and separating substances and the like, are suctioned away and a casting is produced that is substantially free of pores or inclusions.

A vacuum die casting apparatus according to the invention includes a casting cavity that is evacuatable via a vacuum valve. A liquid casting material is pressable into the casting cavity by means of a piston actuated by an actuator. A filling level sensor detects a predetermined filling level of the casting material in the casting cavity. A position sensor detects the movement of the piston. A control device is connected to the filling level sensor and the position sensor.

The control device generates a closing signal for the vacuum valve when the piston, after reaching a position at which the filling level sensor indicates a predetermined filling level of the casting cavity with casting material, is displaced in a predetermined manner.

In another aspect of the invention, the vacuum valve advantageously operates with a time delay that is as short as possible so that the closing signal can be generated as late as possible; as a result, the closing time is as late as possible, and is substantially independent of fluctuations that occur during the operation of the casting apparatus.

In accordance with another aspect of the invention, the time point at which the closing signal must be generated can be calculated from the piston speed almost in real-time.

Advantageous characteristic curves may be stored in the control device, and the operating condition of the die casting apparatus can be monitored.

Further, operating fluctuations of the casting apparatus are taken into account when generating the closing signal.

DETAILED DESCRIPTION OF THE INVENTION

Figure 1:
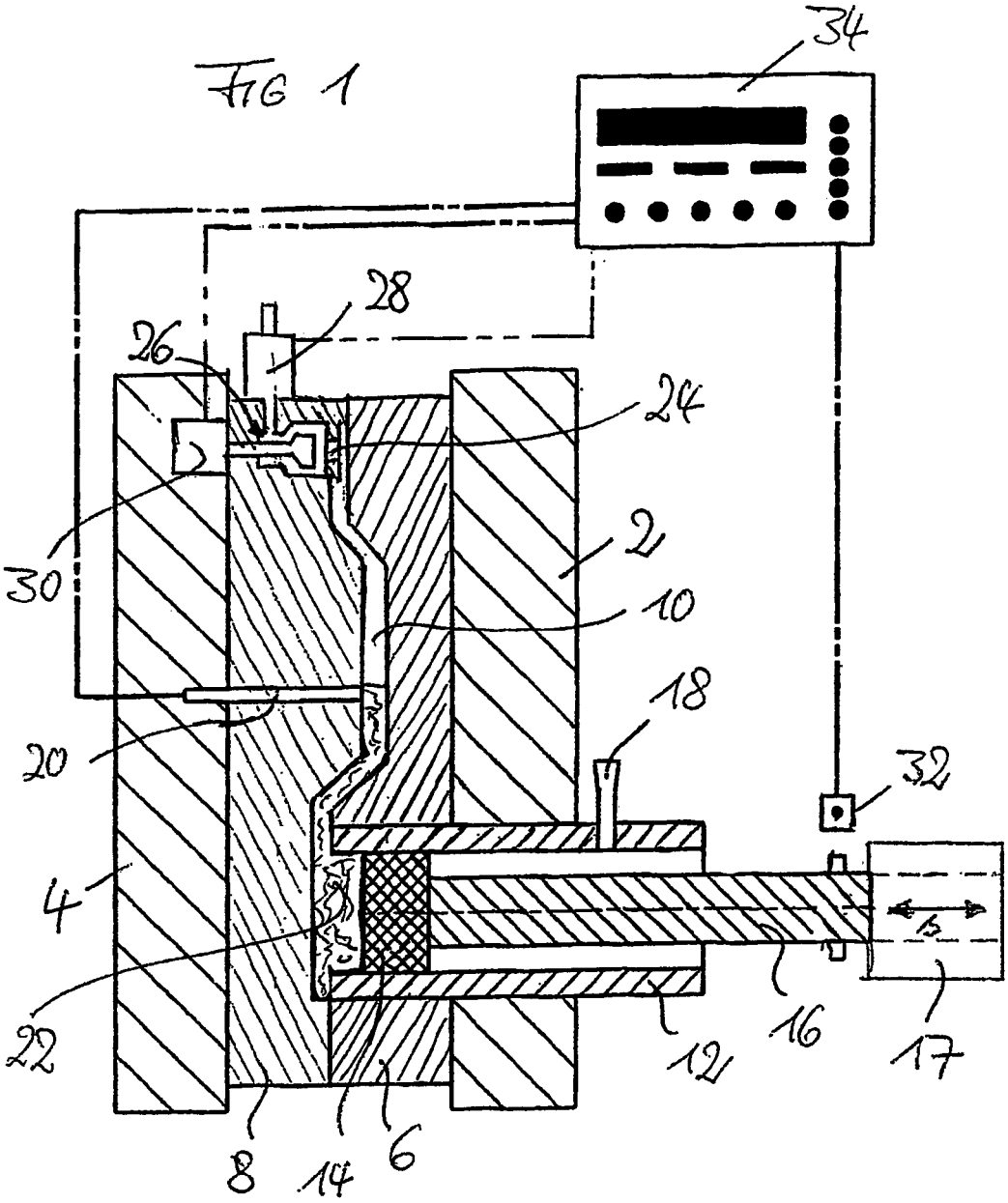
FIG. 1 shows a schematic view of a vacuum die casting apparatus.

As shown in FIG. 1, a vacuum die casting apparatus includes at least two main bodies 2 and 4 that are movable towards and away from each other by means of a drive device (not shown) in a known manner. An associated mold portion 6 and 8 is respectively fixed to each main body. Mutually facing surfaces of the mold portions 6 and 8 are configured such that a casting cavity 10 is formed when the apparatus is closed or when the main bodies are moved towards each other.

A cylinder 12 opens towards the casting cavity 10 and contains a movable piston 14. The cylinder 12 serves to introduce casting material, preferably liquid metal, into the casting cavity 10; the piston 14 is connected via a shaft 16 to an actuator 17 for driving the piston 14. A filling conduit 18 passes through the wall of the cylinder 12 for introducing the liquid casting material.

A filling level sensor 20 is disposed adjoining the casting cavity 10, which filling level sensor 20 generates a signal upon contacting the casting material 22 that rises in the casting cavity 10 when the casting cavity is filled with liquid casting material. A vacuum opening 24 adjoins the upper end region of the casting cavity 10 and the vacuum opening 24 is connected via a vacuum valve 26 to a vacuum pump 28. The vacuum valve 26 is configured such that, in response to a closing signal, the valve member of the vacuum valve moves with the shortest possible delay into the valve closed position. Actuation of the valve member is effected, for example, by means of an actuator, e.g., a solenoid 30. The actuation can also be suitably effected hydraulically or by other means.

The stroke position of the piston 14 or the shaft 16 is detected by a motion sensor 32. The motion sensor 32 can be, for example, a linear sensor. In the alternative, if the linear movement of the piston is converted into a rotational movement by a suitable mechanism, the motion sensor 32 may be an incremental rotational motion sensor.

The motion sensor 32, the filling level sensor 20 and the solenoid of the vacuum valve 26 are connected to a control device 34 that includes a microprocessor with associated storage devices, a display unit, for example in the form of a display, and operating elements.

The structure and function of the described components are known. The co-operation of the components is described in the following:

It will be assumed that the piston 14 has been moved towards the right in FIG. 1 beyond the outlet port of the filling conduit 18. At that position, liquid metal can be introduced into the evacuated casting cavity 10 via the conduit 18. For example, the space within the cylinder 12 to the left of the piston 14 is filled to between 20% and 60% with liquid casting material, depending on the volume relationships thereof. The piston 14 is then moved towards the left beyond the outlet port of the filling conduit 18. The vacuum valve 26 is open at this time. The vacuum pump 28 is operating so that the casting cavity 10 is subjected to a vacuum. The casting material 22 is pressed into the casting cavity 10 and eventually reaches the filling level sensor 20.

As soon as the casting material 22 reaches the filling level sensor 20, the filling level sensor 20 sends a trigger signal to the control device 34; at the time the trigger signal is sent, the position of the piston 14 is detected by the motion sensor 32 and the detected piston position is stored in the control device 34. Advantageously, the actuator 17, e.g. a hydraulic actuator, is switched to a higher speed by the trigger signal so that the casting material is injected at a higher speed and under a higher pressure into the remainder of the mold cavity.

Figure 2:
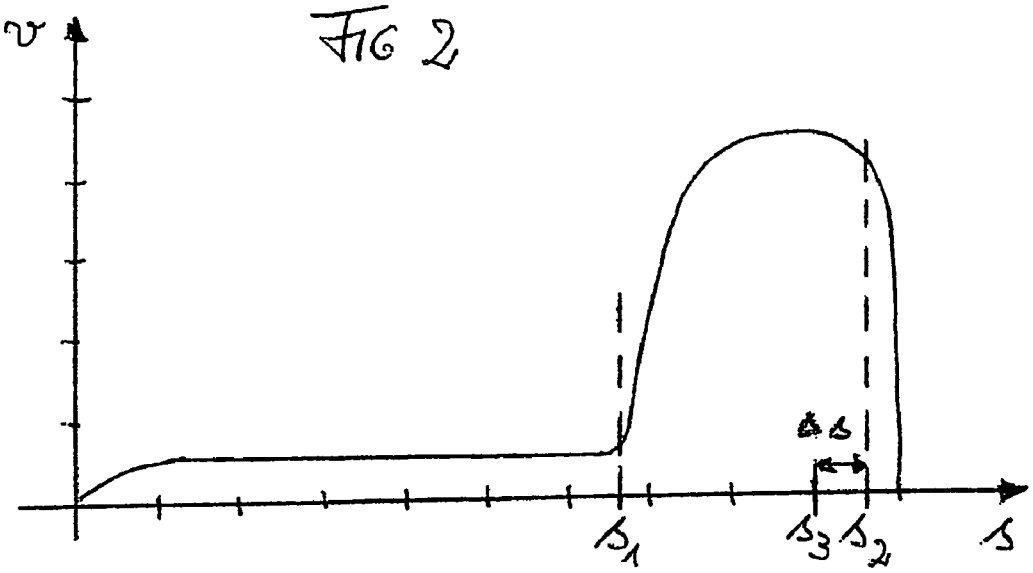
FIGS. 2 and 3 show curves to illustrate an operational mode of the apparatus according to the invention.

FIG. 2 clarifies these relationships. The speed of the piston 14 is illustrated as being dependent upon the distance s that the piston 14 has been displaced. As can be clearly seen, the piston movement begins at a low speed until the position $s_1$, at which position the casting material 22 reaches the filling level sensor 20. The associated position $s_1$ is stored in the control device 34. At the same time, the force or, if provided, the speed, with which the actuator 17 drives the piston 14, is switched to a high value. It will be assumed that the position $s_2$ of the piston 14 corresponds to the position at which the casting material reaches the vacuum opening 24 of the vacuum valve 26; in other words, it is the piston position at which the vacuum valve 26 must be closed in order to avoid being damaged by the casting material. It will further be assumed that the piston moves by the distance $\Delta s$ within the predetermined time delay period $\Delta t$ that is required to close the vacuum valve 26 in response to the generation of a closing signal. Therefore, as can be readily seen from FIG. 2, the closing signal for the vacuum valve 26 must be generated at the time when the piston is disposed at the position $s_3$. Because the position $s_1$ of the piston is stored in the control device 34, the distance $s_3-s_2$ or the position $s_3$ of the piston 14 can be accurately detected by the motion sensor 32, and the closing signal for the vacuum valve 26 can be generated at that time.

Figure 3:
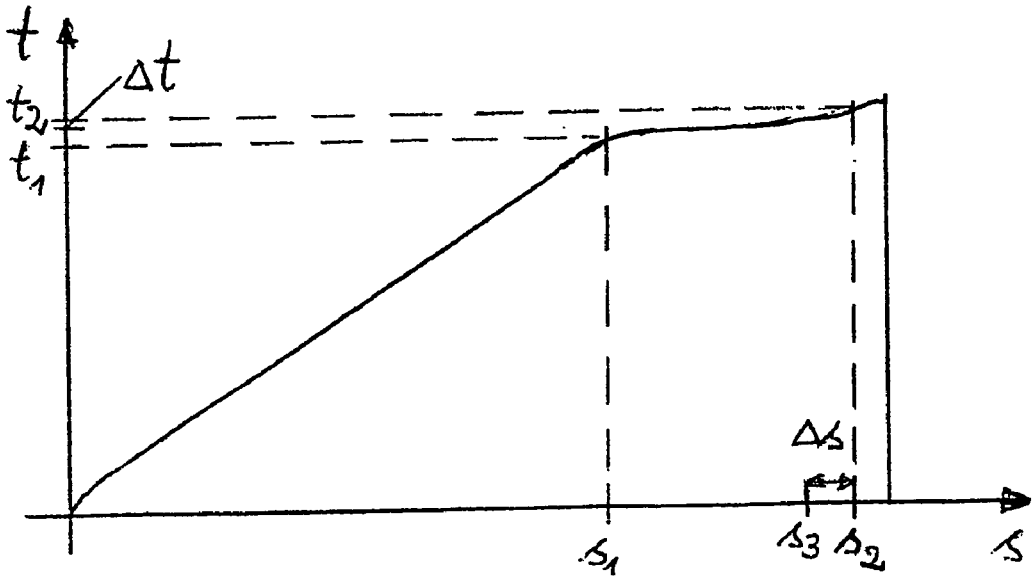

FIG. 3 provides a characteristic curve indicating the change of the piston position over time. FIG. 3 additionally shows the time delay $\Delta t$ of the vacuum valve 26.

It will be appreciated that the characteristic curve of FIG. 2 can be generated by differentiation of the characteristic curve of FIG. 3. Depending on the particular design configuration of the motion sensor 32, the characteristic curve of FIG. 2 or FIG. 3 can be recorded directly. Thus, the characteristic curve of FIG. 3 can be generated by integration of the characteristic curve of FIG. 2 or the characteristic curve of FIG. 2 can be generated by differentiation of the characteristic curve of FIG. 3.

Depending upon the construction of the vacuum valve and the arrangement thereof in the casting cavity, it is possible to completely fill the casting cavity when the piston 14 reaches the position $s_2$ (casting material reaches the vacuum opening 24); or, as illustrated in the Figures, the casting cavity can be only substantially filled, so that the piston is still displaced a short additional distance. It will be appreciated that the piston can also be controlled in such a way that the piston is braked at the position $s_2$.

It is advantageous for the characteristic curve of FIG. 2 to be stored as a target or reference characteristic curve that corresponds to a functionally acceptable operational condition of the casting apparatus. That reference characteristic curve can then serve to determine the piston position $s_3$ for generating the closing signal for the vacuum valve.

The reference characteristic curve can be continuously displayed together with an actual characteristic curve, for example on a display screen, so that operating changes in the die casting apparatus are directly visible and any faults can be recognised at an early stage. In addition, in the series production of castings, the characteristic curve, which curve is used to ascertain the position $s_3$, can be continuously updated. For example, the actual characteristic curve of an immediately preceding casting operation may be used as the characteristic curve for ascertaining $s_3$, or a characteristic curve may be used that is derived from a plurality of preceding casting operations.

Overall, the invention provides that the casting cavity is subjected to the effect of a vacuum as long as possible during the casting operation so that high quality vacuum die castings are produced. The elimination of pores in the die castings is further improved due to the fact that the final phase of the casting procedure is performed under a high casting pressure provided by the higher piston force. Thus, if any pores are not suctioned away by the vacuum and remain in the die casting, due to the gas being contained therein, the pore volume can be reduced by the relatively high piston force utilized to force the casting material into the casting cavity during the final stage of the casting operation.

The apparatus according to the invention can be developed and modified in many different ways.

For example, a plurality of connections extending from a casting cavity 10 to vacuum valves, and a plurality of filling level sensors, can be provided in the die casting apparatus; in this case, the use of the method according to the invention assumes that no changes occur in the relationships of the degrees of filling of the individual passages, which are disposed between the filling level sensors and the vacuum valves. As is immediately apparent, visualization of the characteristic curve of FIG. 2 is advantageous due to the good resolution thereof; however, it is also possible to display other characteristic curves. It is further possible for the closing signal not to be generated based upon the piston reaching the predetermined position ($S_3$) in FIG. 2, but rather by the piston moving at a predetermined speed, and the like.

REFERENCE NUMBER LIST main body
main body
mold portion
mold portion
casting cavity cylinder
piston
shaft
actuator
filling conduit
filling level sensor
casting material
vacuum opening
vacuum valve
vacuum pump
solenoid
motion sensor
control device

What is claimed is:

1. A method for controlling a vacuum valve of a vacuum die casting apparatus, comprising:

applying a vacuum via the vacuum valve to a casting cavity, moving a piston so as to press a liquid casting material into the evacuated casting cavity, continuously detecting the movement of the piston, detecting when the casting material has reached a predetermined filling level within the casting cavity, and marking the position of the piston when the casting material has reached the predetermined filling level, and actuating the vacuum valve so as to close the vacuum valve just before the casting material reaches a connection of the vacuum valve to the casting cavity, wherein the vacuum valve is closed when the piston has moved a predetermined distance from the marked position.

2. A method as set forth in claim 1, wherein the predetermined distance is the difference between:

(i) a distance ($s_2-s_1$) by which the piston moves from the marked position ($s_1$), until the casting material reaches the connection of the vacuum valve and the casting cavity, and (ii) a distance ($s_2-s_3$) by which the piston moves during a predetermined time delay period, wherein the vacuum valve switches into its closed position after the time delay in response to a closing signal.

3. A method as set forth in claim 1, further comprising increase the speed at which the piston is moved when the predetermined filling level is reached, thereby increasing the rate and force at which the casting material is pressed into the casting cavity.

4. A method as set forth in claim 1, wherein the movement of the piston is detected by a motion sensor, the method further comprising:

differentiating the change of the piston position, as detected by the motion sensor, with respect to time, thereby calculating the speed of the piston movement, and determining the time point at which the closing signal for the vacuum valve is generated based upon the piston speed of the piston and an instantaneous position of the piston.

5. A method as set forth in claim 1, determining the time point at which the closing signal is generated based upon a stored characteristic curve, wherein the stored characteristic curve indicates at least one of: (i) the piston position in dependence on time and (ii) the piston speed in dependence on the piston position.

6. A method as set forth in claim 5, wherein the characteristic is stored as a reference characteristic curve.

7. A method as set forth in claim 6, further comprising displaying deviations between the reference characteristic curve and an actual characteristic curve.

8. A method as set forth in claim 7, further comprising continuously updating the stored characteristic curve.

9. A method as set forth in claim 8, further comprising increase the speed at which the piston is moved when the predetermined filling level is reached, thereby increasing the rate and force at which the casting material is pressed into the casting cavity.

10. A vacuum die casting apparatus comprising:

a casting mold defining a casting cavity therein, a piston arranged and constructed to press a casting material into the casting cavity, an actuator arranged and constructed to move the piston, a vacuum valve in communication with the casting cavity and adapted to be connected to a vacuum source, a filling level sensor arranged within the casting cavity so as to detect when the casting material has reached a predetermined filling level within the casting cavity, a position sensor arranged to continuously detect movement of the piston and to detect the position ($s_1$) of the piston when the filling level sensor detects that the casting material has reached the predetermined filling level, and a control device is arranged and constructed to generate a valve closing signal based upon signals received from the filling level sensor and the position sensor and to communicate the valve closing signal to the vacuum valve, wherein the closing signal is generated when the piston has been displaced by a predetermined distance ($s_3-s_1$) from the piston position ($s_1$) detected when the filling level sensor detected that the casting material had reached the predetermined filling level.

11. A vacuum die casting apparatus as set forth in claim 10, wherein the control device includes a storage device adapted to store a characteristic curve that indicates at least one of (i) the piston position in dependence on time and (ii) the piston speed in dependence on the piston position.

12. A vacuum die casting apparatus as set forth in claim 11, further comprising a display device arranged and constructed to display deviations between a stored reference characteristic curve and a recorded actual characteristic curve.

13. An vacuum die casting apparatus, comprising:

means for applying a vacuum via a vacuum valve to a casting cavity, means for moving a piston so as to press a liquid casting material into the evacuated casting cavity, means for continuously detecting the movement of the piston, means for detecting when the casting material has reached a predetermined filling level within the casting cavity, means for marking the position of the piston when the casting material has reached the predetermined filling level, and means for actuating the vacuum valve so as to close the vacuum valve just before the casting material reaches a connection of the vacuum valve to the casting cavity, wherein the actuating means is adapted to close the vacuum valve when the piston has moved a predetermined distance from the marked position.

* * * * *